US007997717B2

(12) United States Patent
Taniuchi et al.

(10) Patent No.: US 7,997,717 B2
(45) **Date of Patent: *Aug. 16, 2011**

(54) IMAGE FORMING METHOD, IMAGE FORMING APPARATUS, INTERMEDIATE TRANSFER BODY, AND METHOD OF MODIFYING SURFACE OF INTERMEDIATE TRANSFER BODY

(75) Inventors: Hiroshi Taniuchi, Yokohama (JP); Akihiro Mouri, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/561,528

(22) PCT Filed: Jun. 22, 2004

(86) PCT No.: PCT/JP2004/009090

§ 371 (c)(1),
(2), (4) Date: Dec. 20, 2005

(87) PCT Pub. No.: WO2004/113082

PCT Pub. Date: Dec. 29, 2004

(65) Prior Publication Data

US 2006/0152566 A1 Jul. 13, 2006

(30) Foreign Application Priority Data

Jun. 23, 2003 (JP) ..... 2003-178547
Jun. 23, 2003 (JP) ..... 2003-178548

(51) Int. Cl.
*B41J 2/01* (2006.01)

(52) U.S. Cl. ..... 347/103; 347/101; 347/95; 347/96

(58) Field of Classification Search ..... 347/88, 347/89, 96, 65, 99–103, 95
See application file for complete search history.

(56) References Cited

U.S. PATENT DOCUMENTS 4,673,303 A * 6/1987 Sansone et al. ..... 347/103
5,470,691 A * 11/1995 Arai et al. ..... 430/273.1
5,805,191 A * 9/1998 Jones et al. ..... 347/103
6,059,407 A * 5/2000 Komatsu et al. ..... 347/103
6,106,762 A 8/2000 Agur et al.
6,109,746 A * 8/2000 Jeanmaire et al. ..... 347/103
6,318,853 B1 * 11/2001 Asano et al. ..... 347/103
6,510,307 B2 1/2003 Sato et al.

(Continued)

FOREIGN PATENT DOCUMENTS

CN 1360230 7/2002

(Continued)

*Primary Examiner* — Matthew Luu
*Assistant Examiner* — Henok Legesse
(74) *Attorney, Agent, or Firm* — Fitzpatrick, Cella, Harper & Scinto

(57) ABSTRACT

The invention allows an image printing on a wide range of print media regardless of how much ink the print media absorb, without sacrificing a high printing flexibility of an ink jet printing system. To this end, the image forming method of this invention includes: a process of modifying a surface of an intermediate transfer body by applying energy to the surface; a process of ejecting ink onto the surface-modified intermediate transfer body by using an ink jet printing device; and a process of transferring ink from the intermediate transfer body to a print medium. With this invention, therefore, an ink image can be formed on the intermediate transfer body having a surface layer, without causing bleeding or beading, and then transferred onto the print medium in good condition.

13 Claims, 5 Drawing Sheets

U.S. PATENT DOCUMENTS

| | | | | |
|---|---|---|---|---|
| 6,527,385 | B2 * | 3/2003 | Koitabashi et al. | 347/101 |
| 6,529,220 | B1 | 3/2003 | Matsumoto | |
| 6,827,434 | B1 * | 12/2004 | Katsuragi et al. | 347/100 |
| 7,278,725 | B2 * | 10/2007 | Koyama et al. | 347/100 |
| 7,419,257 | B2 * | 9/2008 | Mouri et al. | 347/103 |
| 7,661,809 | B2 * | 2/2010 | Taniuchi et al. | 347/103 |
| 2001/0028992 | A1 * | 10/2001 | Mallsion et al. | 430/309 |
| 2002/0041316 | A1 * | 4/2002 | Katsuragi et al. | 347/96 |
| 2003/0020802 | A1 * | 1/2003 | Kreutzkamper et al. | 347/264 |
| 2003/0064206 | A1 * | 4/2003 | Koyano et al. | 428/195 |
| 2003/0068571 | A1 * | 4/2003 | Uehara et al. | 430/126 |
| 2003/0103123 | A1 * | 6/2003 | Snyder | 347/102 |
| 2003/0231234 | A1 * | 12/2003 | Ushirogouchi et al. | 347/100 |
| 2004/0182270 | A1 * | 9/2004 | Wiedemer et al. | 101/465 |
| 2005/0110855 | A1 * | 5/2005 | Taniuchi et al. | 347/103 |
| 2005/0270351 | A1 | 12/2005 | Mouri et al. | |
| 2006/0164488 | A1 | 7/2006 | Taniuchi et al. | |

FOREIGN PATENT DOCUMENTS

| | | |
|---|---|---|
| EP | 1 211 082 | 6/2002 |
| JP | 61-36783 | 2/1986 |
| JP | 5-330035 | 12/1993 |
| JP | 07-089067 | 4/1995 |
| JP | 7-223312 | 8/1995 |
| JP | 07-256873 | 10/1995 |
| JP | 8-230232 | 9/1996 |
| JP | 2000-318300 | 11/2000 |

* cited by examiner

IMAGE FORMING METHOD, IMAGE FORMING APPARATUS, INTERMEDIATE TRANSFER BODY, AND METHOD OF MODIFYING SURFACE OF INTERMEDIATE TRANSFER BODY

TECHNICAL FIELD

The present invention relates to an image forming method and an image forming apparatus both using an ink jet printing system, an intermediate transfer body used in the image forming method and a method of modifying a surface of the intermediate transfer body. More particularly the present invention relates to an image forming method and an image forming apparatus, both of which use an intermediate transfer body in forming an image on a print medium in order to make it unlikely for an image quality to be affected by the amount of ink absorbed in the print medium, an intermediate transfer body used in the image forming method and a method of modifying a surface of the intermediate transfer body.

BACKGROUND ART

A mainstream image forming method using paper as print media is currently an offset printing. The offset printing is a technique suited for mass printing. That is, a printing plate for an image is fabricated and set in a printing machine to make copies of the image at a rate of about 9,000 copies per minute. Disadvantages of the offset printing, such as time and cost required by a printing plate production process and a vast investment needed to purchase the printing machine, have little adverse effect on the cost per printed sheet and speed because the printed matter is produced in large quantities. It can therefore be said that the offset printing has matched market needs very well.

As a trend is gaining momentum in recent years for information versatility and more and more diversified printed matters are printed in small quantities, a problem has surfaced that the production cost of printing plates for individual printed matters becomes relatively high. Further, since instant availability of desired information is being given greater importance, there is a growing demand for a shorter production period in which a printed matter becomes available. Since the current offset printing has a long lead time, from a text preparation to a printing plate production and a printing familiarization (stabilizing of a printing machine), the production period cannot be shortened even when the number of printed copies is small. Further, since a huge facility investment is necessary and all processes require high levels of skills, production locations are limited, which means it takes time for printed matters to be delivered to customers.

In terms of meeting the market demands described above, the ink jet printing system is drawing attention as a desirable technology. Since the ink jet printing system uses no printing plate, it is suited for printing a small number of copies. Further, since it does not require large-scale facilities or a high level of specialty knowledge, desired printed matters can be produced on demand and therefore growing expectations are placed on the ink jet printing system.

Among points in which printed matters produced by the ink jet printing are inferior to offset-printed matters are a glossiness of printed matter, a printability on thin paper, a printability on both sides of paper and a printing cost. If improvements are made on these points, the ink jet printing system can be expected to advance toward commercial printing.

The glossiness of printed matter is affected largely by a surface smoothness of paper (print medium). The ink jet printing system has often used a penetration type ink that permeates paper and fixes in it. Since a colorant of ink fixes following the surface of paper, the paper used needs to have a highly smooth surface to produce a glossiness.

Paper with a highly smooth surface generally has a low ink absorbing capability. This is because a penetration type ink is absorbed through a capillary attraction. If printing is done on paper with a small ink absorption capability, ink may remain on the surface without being fully absorbed in paper, which may cause undesired phenomena, such as a bleeding in which the remaining ink becomes mixed with adjoining ink droplets and a beading in which previously landed ink droplets are drawn to subsequently landed ink droplets, resulting in a degradation of a printed image quality and a failure to dry properly. Under these circumstances, it is very difficult to form an image on paper with a high level of surface smoothness using the ink jet printing system without causing these problems.

The ink jet printing system is available in two types: a continuous type and an on-demand type, the latter type using electrothermal transducers (heating elements) and electromechanical transducers (piezoelectric elements). In either type only low-viscosity ink can be ejected. This is because the ink used in the ink jet printing system is required to be highly fluid while in the ink jet head to realize an adequate ink ejection performance. At the same time, on the surface of the print medium the ink is required to exhibit a low fluid characteristic to prevent adjoining ink droplets from getting mixed or from being drawn to each other. In the ink jet printing system as described above, while a highly fluid ink is ejected onto the print medium, the ink on the print medium needs to have a low fluidity. That is, opposing characteristics are required of the ink depending on whether it is in the print head or on the surface of the print medium.

To meet the contradictory requirements for the ink at the same time, a new system (an image forming system using an intermediate transfer body) is proposed in which an ink image is formed on a transfer body (or an intermediate transfer body), from which it is transferred onto a desired print medium to form the ink image on the print medium. In this system an ink ejected from the ink jet head is affixed to the transfer body temporarily to form an ink image on the transfer body whose fluidity is lowered to some extent while on the transfer body, and then the ink image is transferred from the transfer body onto the print medium.

When such a transfer body is used, it is desired that the surface of the transfer body be made a surface having a small ink absorbing capability or particularly a non-ink absorbing surface, considering an ink transferability from the transfer body to the print medium and an ease with which the transfer body can be cleaned after image transfer. However, if a transfer body with a non-ink absorbing surface is simply used, an ink on the transfer body remains fluidized, making it difficult to hold an ink image on the transfer body in good condition. That is, the use of the non-ink absorbing surface as the intermediate transfer body surface to enhance the transferability of an ink image from the intermediate transfer body makes it difficult to hold the ink image on the intermediate transfer body in good condition. Conversely, if the surface of the transfer body is made a surface that has a high ink absorbing capability to enhance the ability to hold the ink image on the intermediate transfer body, it becomes difficult to keep a good transferability of the ink image from the intermediate transfer body.

In the image forming system using the intermediate transfer body as described above, it is important in keeping a high quality of an ink image on the print medium to strike a good balance between a high level of capability to hold an ink image on the intermediate transfer body and a high level of transferability of the ink image from the intermediate transfer body. However, an image forming system has yet to be realized which establishes both a high level of capability to hold an ink image on the intermediate transfer body and a high level of transferability of the ink image from the intermediate transfer body and which can form a high quality of ink image on a variety of kinds of print media.

In Japanese Patent Application Laid-open No. 5-330035 (1993), for example, a method is proposed in which a transfer body is heated to increase a density of ink on the transfer body and thereby lower an ink fluidity on the transfer body. Simply heating the transfer body, however, can lower the ink fluidity only to a small extent, resulting in an ink image instantly spreading on the transfer body. That is, the ink image cannot be held in good condition on the transfer body, which in turn renders the ink image on a print medium after transfer unsatisfactory. This method has a problem that heat of the transfer body may reach an ink jet head and dry ink ejection nozzles, causing ejection failures. This method therefore has not yet been put to practical use.

Another method has been proposed which, as in Japanese Patent Application Laid-open No. 7-223312 (1995), uses a hot-melt ink and heats an ink jet head and an ink supply system to eject the melted hot-melt ink. In this case, however, since a thickness of affixed ink is large, an ink image formed on the print medium after transfer looks unnatural, making the quality of the image on the print medium after transfer less than satisfactory, similar to the method disclosed in Japanese Patent Application Laid-open No. 5-330035 (1993). When the hot-melt ink is used, the ink needs to be heated to a desired melted state. This melting process takes time and there are some limitations on the components of ink, leaving much to be desired.

DISCLOSURE OF THE INVENTION

As can be seen from the above, in the ink jet printing system the use of an intermediate transfer body is advantageous in enhancing a level of freedom in the selection of print media. However, even the system employing the intermediate transfer body still has room for improvement to make a transferred ink image on the print medium high in quality.

One of important tasks that need to be addressed, in particular, is to cope with two contradicting requirements, i.e., a high ink image retainability on the intermediate transfer body and a high ink image transferability from the intermediate transfer body to a print medium, to make the transferred ink image on the print medium a quality image.

The present invention has been accomplished with a view to overcoming the above problem. It is therefore an object of this invention to provide an image forming method and an image forming apparatus which can provide a unique combination of a high ink image retainability on an intermediate transfer body and a high ink image transferability from the intermediate transfer body to a print medium in order to allow a high quality image printing on a wide range of print media regardless of how much ink the print media absorb, without sacrificing the high printing flexibility of the ink jet printing system. It is another object of this invention to provide an intermediate transfer body used in the image forming method and also a method of modifying a surface of the intermediate transfer body.

More specifically, this invention makes it possible to form an image on the intermediate transfer body having a surface layer with good releasability, without causing bleeding or beading, and then to transfer the ink removed of water from the intermediate transfer body to the print medium in good condition.

In a first aspect of the present invention, there is provided an image forming method comprising the steps of:

performing surface-modifying processing on a surface of an intermediate transfer body by applying energy to the surface;

forming an image on the surface-modified intermediate transfer body by ejecting ink from an ink jet printing means; and transferring the image formed on the intermediate transfer body onto a print medium.

In a second aspect of the present invention, there is provided an image forming method comprising the steps of:

providing an intermediate transfer body having a surface containing at least one of a fluorine compound and a silicone compound, and being surface-modified through plasma processing for modification of the surface;

forming an image on the intermediate transfer body by ejecting ink from an ink jet printing means; and transferring the image formed on the intermediate transfer body onto a print medium.

In a third aspect of the present invention, there is provided an image forming apparatus comprising:

means for mounting an intermediate transfer body being surface-modified through application of energy for modification of the surface;

means for forming an image on the intermediate transfer body mounted on the mounting means by ejecting ink from an ink jet printing means; and means for transferring the image formed on the intermediate transfer body onto a print medium.

In a fourth aspect of the present invention, there is provided an image forming apparatus comprising:

means for mounting an intermediate transfer body having a surface containing at least one of a fluorine compound and a silicone compound, and being surface-modified through plasma processing for modification of the surface;

means for forming an image on the intermediate transfer body mounted on the mounting means by ejecting ink from an ink jet printing means; and means for transferring the image formed on the intermediate transfer body onto a print medium.

In a fifth aspect of the present invention, there is provided an image forming method using an intermediate transfer body being surface-modified through application of energy for modification of the surface, the method comprising the steps of:

applying a first liquid for increasing an ink viscosity to the intermediate transfer body;

forming an image by ejecting ink from an ink jet printing means onto the intermediate transfer body already applied with the first liquid; and transferring the image formed on the intermediate transfer body onto a print medium.

In a sixth aspect of the present invention, there is provided an image forming apparatus method comprising the steps of:

providing an intermediate transfer body having a surface containing at least one of a fluorine compound and a silicone compound, and being surface-modified through plasma processing for modification of the surface;

applying a first liquid for increasing an ink viscosity to the intermediate transfer body;

forming an image by ejecting ink from an ink jet printing means onto the intermediate transfer body already applied with the first liquid; and transferring the image formed on the intermediate transfer body onto a print medium.

In a seventh aspect of the present invention, there is provided a surface-modifying method of an intermediate transfer body comprising a step of surface-modifying through application of energy, the intermediate transfer body being used for forming an image formed of ink onto the surface, and for transferring the image formed on the surface onto a print medium.

In an eighth aspect of the present invention, there is provided a surface-modifying method of an intermediate transfer body comprising the steps of:

providing an intermediate transfer body having a surface containing at least one of a fluorine compound and a silicone compound, and being used for forming an image formed of ink onto the surface, and for transferring the image formed on the surface onto a print medium, and;

surface-modifying the provided intermediate transfer body through application of energy for modification of the surface.

In a ninth aspect of the present invention, there is provided an intermediate transfer body being surface-modified through application of energy, and being used for forming an image formed of ink onto the surface, and for transferring the image formed on the surface onto a print medium.

In a tenth aspect of the present invention, there is provided an intermediate transfer body having a surface containing at least one of a fluorine compound and a silicone compound, being surface-modified through plasma processing for modification of the surface, and being used for forming an image formed of ink onto the surface, and for transferring the image formed on the surface onto a print medium.

In an eleventh aspect of the present invention, there is provided an image forming method comprising the steps of:

performing surface-modifying processing on a surface of an intermediate transfer body through plasma processing and surfactant application, the surface containing at least one of a fluorine compound and a silicone compound;

forming an image on the surface-modified intermediate transfer body by ejecting ink; and transferring the image formed on the intermediate transfer body onto a print medium.

In a twelfth aspect of the present invention, there is provided an image forming method comprising the steps of:

providing an intermediate transfer body having a surface containing at least one of a fluorine compound and a silicone compound, and being surface-modified through plasma processing and application of a surfactant for modification of the surface;

forming an image on the surface-modified intermediate transfer body by ejecting ink from an ink jet printing means; and transferring the image formed on the intermediate transfer body onto a print medium.

In a thirteenth aspect of the present invention, there is provided an image forming apparatus using an intermediate transfer body having a surface containing at least one of a fluorine compound and a silicone compound, the apparatus comprising:

means for surface-modifying processing on the intermediate transfer body through plasma processing and surfactant application, means for forming an image on the surface-modified intermediate transfer body by ejecting ink; and means for transferring the image formed on the intermediate transfer body onto a print medium.

In a fourteenth aspect of the present invention, there is provided an image forming apparatus comprising:

means for mounting an intermediate transfer body having a surface containing at least one of a fluorine compound and a silicone compound, and being surface-modified through plasma processing and surfactant application for modification of the surface;

means for forming an image on the intermediate transfer body mounted on the mounting means by ejecting ink from an ink jet printing means; and means for transferring the image formed on the intermediate transfer body onto a print medium.

In a fifteenth aspect of the present invention, there is provided an image forming method comprising the steps of:

subjecting a surface of an intermediate transfer body to plasma processing;

applying a liquid onto the intermediate transfer body after plasma processing, the liquid containing a surfactant for improving a wettability of the surface of the intermediate transfer body;

applying a reactant liquid for reacting to ink onto the intermediate transfer body to which the liquid containing the surfactant was applied;

forming an image on the intermediate transfer body after application of the reactant liquid by ejecting ink from an ink jet printing means; and transferring the image formed on the intermediate transfer body onto a print medium.

In a sixteenth aspect of the present invention, there is provided an image forming method comprising the steps of:

providing an intermediate transfer body having a surface containing at least one of a fluorine compound and a silicone compound, and being surface-modified through plasma processing and application of a liquid containing a surfactant for modification of the surface;

applying a liquid onto the intermediate transfer body after plasma processing, the liquid reducing the fluidity of an ink on the intermediate transfer body;

forming an image on the intermediate transfer body after application of the liquid by ejecting ink from an ink jet printing means; and transferring the image formed on the intermediate transfer body onto a print medium.

In this specification, "print medium" refers not only to paper commonly used in printing devices but also widely to cloth, plastic films and any other material capable of receiving ink.

An ink jet printing means applicable to this invention includes a variety of types of ink jet heads proposed for ink jet printing, such as one that utilizes thermal energy generated by electrothermal transducers to cause film boiling in ink and thereby form bubbles to eject ink, one that uses electromechanical transducers to eject ink, and one that utilizes static electricity or air flow to eject ink droplets. Of these, the electrothermal transducer-based ink jet head is advantageously used from the standpoint of size reduction.

BEST MODE FOR CARRYING OUT THE INVENTION

Example embodiments of the present invention will be described in detail by referring to the accompanying drawings.

I. First Embodiment

1. Outline of Image Forming Device

Figure 1:
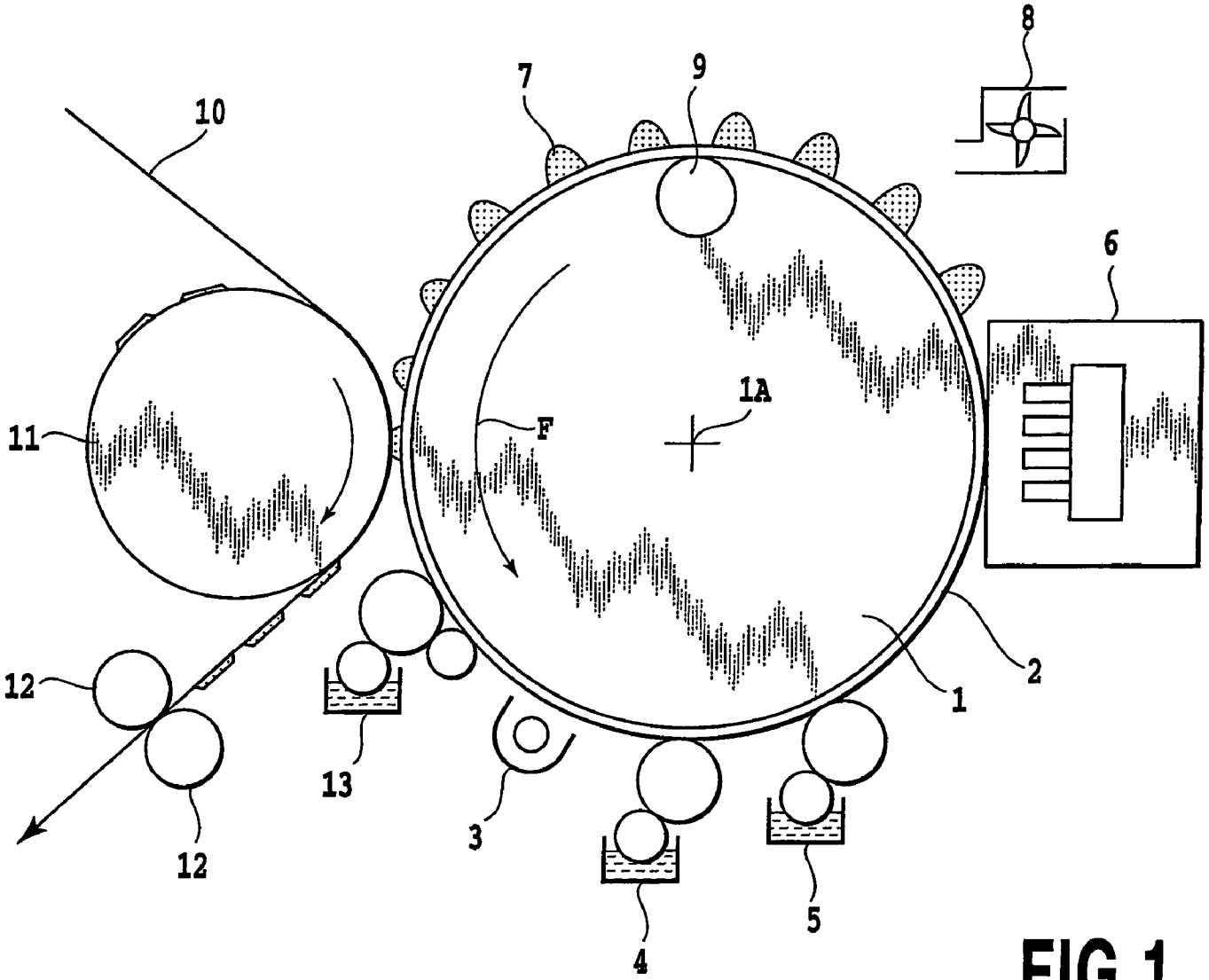
FIG. 1 is a schematic diagram showing an outline configuration of an image forming apparatus according to one embodiment of this invention.

FIG. 1 is a schematic diagram showing an outline configuration of an image forming apparatus according to one embodiment of this invention. In FIG. 1, reference number 1 denotes an intermediate transfer body which is driven to rotate about an axis 1A in a direction of arrow F and has a surface layer 2 with good releasability. In FIG. 1, reference number 3 represents an energy application device that performs surface modifying processing on the surface layer 2. In the device shown in FIG. 1, application devices 4, 5 are put in contact with the surface of the intermediate transfer body 1 between the energy application device 3 and an ink jet printing unit 6 to apply a wettability improvement component and an ink viscosity increasing component to the surface. Although the application device 4 for applying a wettability improvement component such as surface active agent and the application device 5 for applying an ink viscosity increasing component do not have to be provided, they are preferably installed from a standpoint of improving the capability of the intermediate transfer body to hold an ink image.

After these components have been applied to the surface, the ink jet printing unit 6 ejects ink droplets onto the surface of the intermediate transfer body 1 to form an image (mirror image) on the surface. Then, a print surface of a print medium 10 is brought into contact with the image formed on the intermediate transfer body 1 and a pressure roller 11 is pressed against a back of the print medium 10 to transfer the image onto the print medium 10.

In the device shown in FIG. 1, a water removal facilitating device 8 is provided in the form of a fan to evaporate and remove water or solvent components from the ink that forms the image on the intermediate transfer body 1. In addition to or in place of this arrangement, a heat roller 9 may be used which is placed in contact with a back side of the hollow intermediate transfer body 1.

The print medium 10, after being printed with an image through the intermediate transfer body 1 as described above, is pressurized between fixing rollers 12 to have an excellent surface smoothness. It is also possible to heat the print medium 10 with the fixing rollers 12 to instantly give the printed material a durability.

Then, in the device of FIG. 1, after having transferred the ink image to the print medium 10, the intermediate transfer body is washed by a cleaning unit 13 at the next stage in preparation for receiving the next image.

In the conventional ink jet printing system, ink fixing is mostly achieved by the penetrating of ink into paper as the print medium and the state of image formed varies depending on the amount of ink absorbed in the print medium. So, there are limitations on the kinds of print media that can be used. The offset printing device on the other hand, because it is designed for mass printing of the same printed matter, lacks flexibility as when producing different image outputs on different pages.

With the present invention, however, the following advantages are produced. As can be seen from the above-described image forming apparatus embodying this invention, the kinds of print media are not limited by the amount of ink absorbed in the print medium, allowing a high quality printing on a wide range of media. This in turn realizes an image forming that takes advantage of the features of the ink jet printing system, such as an excellent flexibility of being able to instantly produce a desired printed matter.

2. Description of Processes

The image forming apparatus described above includes means to perform a process of modifying the surface of the intermediate transfer body 1 having a surface layer with good releasability through energy application (hereinafter referred to as a process (X)), a process of forming an image by the ink jet printing system on an intermediate transfer body having the modified surface (process (Y)), and a process of transferring the ink image formed on the intermediate transfer body 1 onto a print medium (process (Z)). These processes (X)-(Z) and the means for implementing them will be explained by way of example.

2.1 Process (X)

The process (X) modifies the surface of the intermediate transfer body 1 having a surface layer with good releasability by energy application.

In the embodiment of FIG. 1, a drum made of light metal such as aluminum alloy is used as a support for the surface layer of the intermediate transfer body, considering characteristic requirements including a stiffness to withstand a pressure applied during a transfer process, a dimensional accuracy and a control responsivity that can be improved through a reduction in rotary inertia. On the drum surface is provided the surface layer 2, thus forming the intermediate transfer body 1.

The intermediate transfer body or the support for its surface layer, however, is only required to ensure that the surface layer can at least be in line contact with the print medium. Depending on the configuration of the image forming apparatus or the form of transfer onto the print medium; they may be formed into a shape of roller, belt or sheet. In addition to the materials that assure the line contact, the intermediate transfer body may also use materials with large elastic deformations, such as a pad which is used in a pad printing.

As shown in FIG. 1, on the surface of the intermediate transfer body 1 is formed the surface layer 2 with good releasability. In this specification, the good releasability means a state in which an ink image can be removed without adhering to the surface of the intermediate transfer body. The higher the releasability, the more advantageous the surface layer 2 is in terms of a load during cleaning and an ink transfer rate. On the contrary, as the releasability increases, a critical surface tension of a material generally decreases, making the material more likely to repel a liquid such as ink, which in turn renders the ink image more difficult to retain on the surface layer. A material preferably used in this invention exhibits a physical property before surface treatment such that its water repellency is 30 mN/m or less in critical surface tension or 70 degrees or more in contact angle with water. That is, the preferred material for the intermediate transfer body of this invention has a property such that the intermediate transfer body, before being surface treated, repels applied ink which therefore fails to form an image (i.e., the ink image retention capability is low) as long as ordinary means is used.

More specifically, the surface layer 2 with good releasability may be formed by performing surface treatments, such as coating fluorine on the surface of the intermediate transfer body or applying silicone oil to the surface. However, it is desired that the surface layer 2 is formed of an elastic material with good releasability because it can achieve a higher transfer efficiency. The elastic material may advantageously use surface-treated NBR and urethane rubber and also fluororubber and silicone rubber both inherently having good releasability. Silicone rubber is available in various types, such as vulcanization type, one-liquid curing type and two-liquid curing type. All of these types can be used properly. Although a hardness of the elastic rubber of the surface layer depends on the thickness and stiffness of the print medium 10 in contact with the surface layer and thus it is desirable to optimize the surface layer hardness, the use of the elastic rubber of with a hardness of between 10 and 100 degrees when measured by type A durometer (conforming to JIS K 6253) produces a desirable effect. Almost all kinds of print media can be dealt with if the elastic rubber has a hardness of between 40 and 80 degrees.

In the process (X) the surface layer 2 of the intermediate transfer body 1 constructed as described above is modified by applying energy to it. The application of energy to the surface of the intermediate transfer body improves a wettability of the surface of the material that has a good releasability, thereby suppressing an ink repellency. The surface of the intermediate transfer body thus obtained has a good image retention capability (an ability to hold ink droplets where they land by properly suppressing the ink repellency) in addition to good cleaning and image transferring capabilities. The means for energy application may be any means that can modify the surface to make it hydrophilic by performing surface treatment, such as ultraviolet radiation, flame-treatment, corona discharging and plasma treatment. Of these, plasma treatment at an atmosphere pressure or reduced pressure is a preferred method which is particularly advantageous if the surface layer with good releasability is formed of a material containing a fluorine compound or silicone compound. Not only can this combination provide an efficient hydrophilic surface treatment but it can also prevent the transfer rate from falling or improve the transfer rate when transferring an ink image formed on the intermediate transfer body onto a print medium in a later process. The plasma treatment mentioned above includes a part of the corona discharge treatment which activates oxygen in atmosphere to produce hydroxyl groups on the surface of a substrate being processed. The fluorine compound or silicone compound includes respective oil component.

A complete mechanism behind the desirable effect produced by the combination of the selected material and the selected surface modification means has yet to be revealed. However, there seems to be a remarkable tendency that, in the presence of fluorine or silicone oil component, both the hydrophilic surface and the maintained or improved transfer rate are clearly observed simultaneously and that the surface, once modified, can retain these lasting effects. Judging from these facts, it is assumed that, in addition to the generally known chemical action of the plasma treatment (introduction of hydrophilic groups on the surface) which makes hydrophilic at least a part of the rubber component, filler component and oil component of the surface layer, a physical action (surface roughening) changes a part of a rubber structure to promote the oil component movement on the surface.

The surface treatment may be implemented as shown in the embodiment of FIG. 1, in which an energy application device 3 modifies the surface of the intermediate transfer body 1 with good releasability continuously or at predetermined intervals. Alternatively the surface treatment may also be performed by not using the energy application device 3 and by using an intermediate transfer body which has its surface modified in advance. These two methods may be combined, i.e., it is possible to use an intermediate transfer body with its surface already modified and perform additional surface modification treatments on the surface layer 2 at appropriate intervals by using the energy application device 3 installed in the system to maximize the surface modification effect according to the number of sheets printed.

2.2 Process (Y)

This is a process of forming an image on the intermediate transfer body by using an ink jet printing unit.

The ink jet printing unit used for image forming is not limited in terms of the ink ejection mode and configuration. The ink jet printing unit may be one that performs ink ejection in a continuous mode or in an on-demand mode using electrothermal transducers (heating elements) or electromechanical transducers (piezoelectric elements). As to the configuration of the ink jet printing unit, let us look at the construction of FIG. 1, for example. An ink jet head may be of a line head configuration in which ink ejection nozzles are arrayed in an axial direction of the intermediate transfer body 1 (in a direction perpendicular to the plane of the drawing). Another type of head may be used which has its nozzles arrayed over a predetermined range in a direction of a tangential line or in a circumferential direction of the intermediate transfer body. Printing is done by scanning this head in the axial direction. Further, it is possible to use the same number of print heads as that of the ink colors used in forming an image.

Inks used in the image forming process (Y) are also not subject to any particular limitations. It is possible to use commonly available dyes and pigments as colorants of ink and also use water-based inks that have aqueous liquid medium to dissolve and/or disperse dyes and pigments. Pigment inks are particularly suitable for producing a durable printed image.

Among possible dyes are C.I. Direct Blue 6, 8, 22, 34, 70, 71, 76, 78, 86, 142, 199, C.I. Acid Blue 9, 22, 40, 59, 93, 102, 104, 117, 120, 167, 229, C.I. Direct Red 1, 4, 17, 28, 83, 227, C.I. Acid Red 1, 4, 8, 13, 14, 15, 18, 21, 26, 35, 37, 249, 257, 289, C.I. Direct Yellow 12, 24, 26, 86, 98, 132, 142, C.I. Acid Yellow 1, 3, 4, 7, 11, 12, 13, 14, 19, 23, 25, 34, 44, 71, C.I. Food Black 1, 2, and C.I. Acid Black 2, 7, 24, 26, 31, 52, 112, 118.

Among possible pigments are C.I. Pigment Blue 1, 2, 3, 15; 3, 16, 22, C.I. Pigment Red 5, 7, 12, 48 (Ca), 48 (Mn), 57 (Ca), 112, 122, C.I. Pigment Yellow 1, 2, 3, 13, 16, 83, Carbon Black No. 2300, 900, 33, 40, 52, MA 7, 8, MCF 88 (Mitsubishi Kasei make), RAVEN1255 (Columbia make), REGAL330R, 660R, MOGUL (Cabot make), Color Black FW1, FW18, S170, S150, and Printex35 (Degussa make).

These pigments are free from any limitations in terms of application mode. They can be used in the form of, for instance, self dispersion type (pigment free of dispersant), resin dispersion type and microcapsule type. Suitable pigment dispersions include a water-soluble dispersion resin with a weight-averaged molecular weight of about 1,000 to 15,000. More specifically, they include water-soluble vinyl resin, block or random copolymers and salts thereof made from styrene and its derivatives, vinylnaphthalene and its derivatives, aliphatic alcohol esters of $\alpha,\beta$-ethylenically-unsaturated carboxylic acid, acrylic acid and its derivatives, maleic acid and its derivatives, itaconic acid and its derivatives, or fumaric acid and its derivatives.

To improve the durability of the image formed, a water-soluble resin and a water-soluble cross-linking agent may be added. The only requirement for these materials is that they can coexist with ink components. As the water-soluble resin, the above-mentioned dispersion resins may be suitably used. As the water-soluble cross-linking agent, oxazoline and carbodiimide, which have slow responsivity, may be suitably used in terms of ink stability.

The aqueous liquid medium making up the ink along with the colorants listed above may contain an organic solvent, and the amount of organic solvent is a determining factor of the property of the ink after its viscosity is raised. In the system using an intermediate transfer body according to this invention, the ink when it is transferred onto the print medium contains almost only the colorant and a high boiling point organic solvent. Considering this fact, the amount of organic solvent is determined at its optimum value. Preferred organic solvents include the following water-soluble materials with a high boiling point and a low vapor pressure.

The organic solvents may include, for example, polyethylene glycol, polypropylene glycol, ethylene glycol, propylene glycol, butylene glycol, triethylene glycol, thiodiglycol, hexylene glycol, diethylene glycol, ethylene glycol monomethyl ether, diethylene glycol monomethyl ether or glycerin. Two or more of these may be mixed for use. To adjust viscosity and surface tension, alcohols such as ethyl alcohol and isopropyl alcohol or surface active agents may be added to ink.

As for a compounding ratio of components making up the ink, there is no limitation. The compounding ratio can be adjusted properly according to the chosen ejection force and nozzle diameters of the ink jet head. The ink may, for example, be composed of 0.1-10% colorant, 5-40% solvent, 0.01-5% surface active agent and the remaining percentage of purified water.

When an image forming is done at high speed, it is effective to provide a process of applying an ink viscosity increasing component to the intermediate transfer body prior to the ink ejection process (Y). The ink viscosity increasing component not only suppresses the fluidity of ink on the intermediate transfer body to minimize bleeding and beading during the high-speed image forming but also improves the capability of retaining an ink image on the intermediate transfer body.

That is, since, during the fast image forming, the amount of ink applied per unit time is greater than normal, bleeding and beading are more likely to occur. On the intermediate transfer body the ink is also likely to become fluidized. Thus, when the device of FIG. 1 is used, the ink viscosity increasing component is applied by the application device 5 prior to ink application so that the ink droplets will land where the ink viscosity increasing component has been applied. This arrangement ensures that the ink and the ink viscosity increasing component come into contact with each other at positions where the ink droplets have landed, reducing the fluidity of the ink and thereby holding the ink where it landed.

Here, an increase in ink viscosity includes not only a case in which colorants and resins making up the composition of ink contact the ink viscosity increasing component to cause a chemical reaction or a physical adsorption, resulting in an overall rise in ink viscosity, but also a case in which solid components of the ink composition coagulate, resulting in a local rise in ink viscosity.

The usable ink viscosity increasing component should properly be chosen according to the kind of ink used for image forming. For a dye ink, for instance, it is effective to use a high molecular coagulant. For a pigment ink having fine dispersed particles, a liquid containing metal ions attributable to coagulation of pigment is advantageously used. Further, if the dye ink as the ink and metal ions as the ink viscosity increasing component are used, it is preferred that a pigment component of an identical color with that of the dye component be mixed into the ink, that white or transparent fine particles which have little effects on the color be added, or that a water-soluble resin which reacts with metal ions be added.

The high molecular coagulants used as the ink viscosity increasing component include, for example, cationic high molecular coagulants, anionic high molecular coagulants, nonionic high molecular coagulants and amphoteric high molecular coagulants. Metal ions include, for example, divalent metal ions such as $Ca^{2+}$, $Cu^{2+}$, $Ni^{2+}$, $Mg^{2+}$ and $Zn^{2+}$, and trivalent metal ions such as $Fe^{3+}$ and $Al^{3+}$. If a liquid containing these metal ions is applied, it is preferably applied in the form of a metal salt solution in water. Among anions of metal salts are $Cl^-$, $NO_3^-$, $SO_4^{2-}$, $I^-$, $Br^-$, $ClO_3^-$ and $RCOO^-$ (R represents an alkyl group).

The amount of ink viscosity increasing component to be applied is preferably set such that the total number of metal ion charges is equal to or more than 0.5-2 times the total number of ion charges of opposite polarity present in the colored ink. For this purpose, a water solution of the metal salts listed above with a density of about 10% by mass may be used. This layer of ink viscosity increasing component, even if thin, can achieve its desired function well.

While FIG. 1 shows the application device 5 of a roll coater type as a preferred application means, other types of application means may also be used, such as a spray coater. It is also possible to use a print head that ejects a liquid of viscosity increasing component by the action of the ink jet mechanism.

For improving the durability of a finally formed image, a water-soluble resin and a water-soluble cross-linking agent may be added. There is no limitation on these materials as long as they can coexist with the ink viscosity increasing component. If metal salts with high reactivity are used as the ink viscosity increasing component, the water-soluble resin may advantageously use PVA and PVP. The water-soluble cross-linking agent may preferably use oxazoline and carbodiimide that reacts carboxylic acid suitably used in ink for colorant dispersion. Aziridine in particular is the material that can provide a combination of an ink viscosity increasing capability and an improved image durability.

For uniform application of the ink viscosity increasing component, it is effective to add a surface active agent or surfactant to the ink viscosity increasing component or, before applying the ink viscosity increasing component, to coat a wettability improving component such as a surfactant to the intermediate transfer body by the application device 4. The wettability improving component is designed to increase an affinity between the intermediate transfer body and the ink viscosity increasing component and therefore preferably uses a surfactant.

Even in a configuration that does not use the ink viscosity increasing component, the application of the wettability improving component such as a surfactant by the application device 4 prior to ink ejection is effective in improving the affinity of the intermediate transfer body with ink.

In forming an image, if the coated layer of the ink viscosity increasing component is thin, there is no problem normally. There are cases, however, in which a better printed result can be obtained by drying well the ink viscosity increasing component after its application by a drying process before ejecting ink. In that case, a drying means may be provided between the application device 5 and the ink jet printing unit 6.

2.3 Process (Z)

This is a process of transferring an ink image formed on the intermediate transfer body 1 onto the print medium 10 which can take a form of continuous paper, such as roll paper and fanfold paper, in addition to cut-sheet paper. The print medium 10 is brought into contact with the image forming surface of the intermediate transfer body 1 by the pressure roller 11 and thereby receives ink. In this embodiment, since at this stage the water in the ink on the intermediate transfer body 1 has already evaporated to some degree and its viscosity has risen, a good quality image can be formed on a print medium even if it has a small ink absorbing capacity.

If, however, the time from the ink image forming in the process (Y) to the image transfer in the process (Z) is too short, the amount of water contained in ink may not decrease by natural evaporation to a level allowed by the print medium. Taking such a case into consideration, the image forming apparatus of FIG. 1 has the water removal facilitating device 8 in the form of a fan (which may send warm air) installed between a position where an ink image is formed and a position where an image transfer is performed, thereby promoting water elimination from ink. Another means for facilitating the water removal may be one which heats the intermediate transfer body from the ink image forming surface side. Alternatively, it may be realized by a heat roller 9 put in contact with the back side of the hollow intermediate transfer body 1 to heat the surface of the intermediate transfer body.

The print medium printed through the intermediate transfer body as described above is pressurized by the fixing rollers 12 to have an excellent surface smoothness. The fixing rollers 12 may also be provided with a function of heating the print medium 10. This will instantly give the printed material a durability.

In the device exemplified in FIG. 1, the intermediate transfer body, after having transferred an ink image to the print medium, is then washed by the cleaning unit 13 installed in the next stage in preparation for receiving the next image. The cleaning means preferably employs a direct cleaning method or a wiping method. The direct cleaning method may involve washing or wiping while spraying water shower or putting the intermediate transfer body surface in contact with water surface. The wiping method may involve holding a wet morton roller against the surface. These two methods may of course be used in combination.

After washing, if necessary, the surface of the intermediate transfer body may be pressed by a dry morton roller or applied air blow for effective drying. Depending on the ink used, the component compounded for the purpose of improving the wettability may be utilized for cleaning. In that case, the wettability improving component application device 4 may also be used as the cleaning means.

2.4 Advantages of Embodiment

The above processes and the means to implement them have been described in detail. The feature of this invention and embodiment can be summarized as having established a technology that can modify a surface of intermediate transfer body having a high transferability, for instance, having a good releasability, into a surface capable of receiving an ink or an ink viscosity increasing component without repelling them. This technology provides a unique combination of a high performance in transferring an ink image from the intermediate transfer body to a print medium and a high capability in holding an ink image on the intermediate transfer body, making the quality of the transferred ink image on the print medium high. Why this is possible will be explained in detail.

The reason that the surface of the intermediate transfer body 1 is given a good releasability is to improve an ink transfer efficiency. With general transfer means including an offset printing, only about half the ink on the surface of the intermediate transfer body is transferred onto the print medium with the remaining half left on the intermediate transfer body. The intermediate transfer body with the residual ink on its surface then receives the next ink supply. In other words, the surface of the intermediate transfer body needs to be supplied two times the amount of ink required on the print medium. If the transfer efficiency is improved, the amount of ink to be supplied to the intermediate transfer body can be reduced. With this invention and embodiment the transfer efficiency can be improved easily and the resulting reduction in the ink supply volume brings about the following five advantages.

(1) Reduced Bleeding and Beading

Bleeding and beading are both caused by contact between ink droplets. Thus a reduction in ink volume supplied to the intermediate transfer body results in reduced chances of contact between ink droplets.

(2) Reduction in Water Evaporation

For an improved transfer efficiency, enhancing an internal coalescent force of ink is strongly desired. But since the ink for ink jet printing generally contains a large amount of water, the internal coalescent force of ink is increased by removing the water. At this time, the smaller the ink volume per unit surface area on the intermediate transfer body, the more quickly and easily the water removal can be done.

(3) Reduction in Dot Gain During Transfer

The greater the ink volume of each dot on the intermediate transfer body, the more likely it is to be flattened by the pressure during its transfer and the larger the dot diameter will be, resulting in a degraded resolution. The reduced volume of ink, however, can prevent this.

(4) Load Reduction During Cleaning

As the volume of remaining ink on the surface of the intermediate transfer body after the transfer decreases, the cleaning becomes easier. Particularly when different images are produced on different sheets, the surface of the intermediate transfer body needs to be cleaned prior to each image forming. In that case, this invention is advantageous.

(5) Improved Ink Utilization

The smaller the ink volume to be discarded by cleaning, the ink utilization improves, which in turn reduces the running cost and the amount of waste.

As described above, the combination of an intermediate transfer body with high cleaning performance and an ink jet printing device as a digital image printing means assures a high quality of printed images even if different images are produced on different sheets.

In addition, the ink jet printing system can use inks with a very small solid content and therefore has a capability of creating an image without sacrificing a unique texture of a print medium or paper. To take advantage of this capability, the surface of the intermediate transfer body is made hydrophilic to allow aqueous ink and ink viscosity increasing component to be applied in a thin layer without being repelled. This not only improves the quality of image but accelerates the water removal by spreading the ink thinly, which in turn results in an additional feature of being able to cope with a high-speed printing.

The surface with good releasability is excellent in terms of the transfer efficiency. But such a surface is generally water repellent and, unless given some kind of surface treatment, repels liquid such as ink, which renders the image holding and forming on this surface difficult. To deal with this problem, i.e., to make it possible to hold and form an ink image on a surface with high ink transfer efficiency is exactly why the surface modification through applying energy such as plasma treatment to the intermediate transfer body is done in this invention or embodiment. By modifying through energy application such as plasma treatment the surface of the intermediate transfer body having high ink transfer efficiency and good releasability, it is possible to make the intermediate transfer body surface suitable for holding ink while maintaining the inherently high ink transfer efficiency.

Further, applying an ink viscosity increasing component to the intermediate transfer body prior to the ink image formation can prevent an image degradation even during a high-speed printing process where a large volume of ink is applied in a short period of time. That is, by reducing the ink fluidity, unwanted phenomena such as ink beading and bleeding can be prevented if the ink droplets should come into contact with each other. In a so-called "solid" printed area, it is difficult to keep adjoining ink droplets from contacting each other however high the transfer efficiency may be set. To the contrary, a water solution of high molecular coagulant and metal ions, listed as examples of the ink viscosity increasing component, can instantly coagulate ink and lower the ink fluidity.

It is however not easy to uniformly coat the ink viscosity increasing component over the surface with good releasability. If only the ink viscosity increasing component is applied, it is repelled on the intermediate transfer body surface. And if a wettability improving agent is to be added, a large volume of the agent will be required. This will make the applied layer thick, offsetting the aforementioned advantage of the reduced volume of ink. It is therefore very effective to modify the surface of the intermediate transfer body having good releasability by applying energy such as plasma treatment to the surface and thereby make the surface sufficiently hydrophilic before applying the ink viscosity increasing component.

Further, even if the ink image formation is made possible by the surface modification, applying ink appropriately to the surface having good releasability is difficult as long as the surface contact method is used for ink application. The object of this invention is realized by using as the image forming method an ink jet printing method which can apply ink appropriately in a noncontact manner.

3. Example Embodiments

Next, some embodiments and examples for comparison will be explained in detail for each printing process. In the description that follows, "part" and "%" are expressed in mass terms unless otherwise specifically stated.

Embodiment 1

(a) Surface Modification of Transfer Body

As an intermediate transfer body this embodiment used an aluminum drum coated with silicone rubber with a hardness of 40 degrees (KE12 of Shinetsu Kagaku make) to a thickness of 0.2 mm. First, the surface of the intermediate transfer body was modified under the following conditions by using an atmospheric pressure plasma processor 3 (ST-7000 of Keyence make).

Irradiation distance: 5 mm
Plasma mode: High
Processing rate: 100 mm/sec (b) Application of Ink Viscosity Increasing Component Next, the intermediate transfer body whose surface was modified was coated with an ink viscosity increasing component using a roll coater. As the ink viscosity increasing component, a 10% by mass aluminum chloride hexahydrate solution in water was used.

(c) Forming of Image on Intermediate Transfer Body

Next, the ink jet printing unit (nozzle density: 1200 dpi (dots/inch), ejection volume: 4 pl, drive frequency: 8 kHz) was operated to form a mirror-inverted character image of aqueous ink on the intermediate transfer body. Here, the ink used has the following composition. When the ink image was formed on the intermediate transfer body, it was retained well and no beading resulted.

Pigment (Carbon black MCF 88 of Mitsubishi Kagaku make): 5 parts
Styrene/acrylic acid/ethyl acrylate copolymer (acid value: 240, weight-averaged molecular weight: 5,000): 1 part
Glycerin: 10 parts
Ethylene glycol: 5 parts
Surfactant (Acetylenol EH of Kawaken Fine Chemicals make): 1 part
Ion-exchange water: 78 parts (d) Transfer The intermediate transfer body, which was subjected to the above series of processes, and surface-coated print paper with little ink absorbing capability (NPi coat paper of A-size of Nippon Paper make, 1000-sheet weight (ream weight; JIS P 0001): 40.5 kg) were brought into contact with each other by the pressure roller to transfer the ink image to the print paper. No beading was found on the image on the print paper and the quality of the characters was good. After the image transfer, there was almost no residual ink on the intermediate transfer body, so the intermediate transfer body was able to receive the next image immediately thereafter without a problem.

Embodiment 2

(a) Surface Modification of Transfer Body

As an intermediate transfer body this embodiment used an aluminum drum coated with silicone rubber with a hardness of 60 degrees (KE30 of Shinetsu Kagaku make) to a thickness of 0.2 mm. First, the surface of the intermediate transfer body was modified under the following conditions by using an atmospheric pressure plasma processor (Plasma Atom Handy of Nippon Paint make).

Irradiation distance: Contact
Plasma mode: Standard
Processing rate: 10 mm/sec (b) Application of Ink Viscosity Increasing Component Next, 0.5% of fluorinated surfactant (Surflon S-141 of Seimi Chemical make) was added to a 10% by mass calcium chloride dihydrate solution in water, and this solution was coated to the surface of the intermediate transfer body whose surface was modified using the roll coater.

(c) Forming of Image on Intermediate Transfer Body

Next, the ink jet printing unit (nozzle density: 1200 dpi, ejection volume: 4 pl, drive frequency: 8 kHz) was operated to form a mirror-inverted character image of four color inks on the intermediate transfer body. Here, the ink used has the following composition. When the ink image was formed on the intermediate transfer body, it was retained well and neither beading nor bleeding resulted.

The following pigments: 8 parts
- Black: Carbon black (MCF88 of Mitsubishi Kagaku make)
- Cyan: Pigment Blue 15
- Magenta: Pigment Red 7
- Yellow: Pigment Yellow 74

Styrene/acrylic acid/ethyl acrylate copolymer (acid value: 240, weight-averaged molecular weight: 5,000): 1 part
Glycerin: 10 parts
Ethylene glycol: 5 parts Surfactant (Acetylenol EH of Kawaken Fine Chemicals make): 1 part Ion-exchange water: 78 parts (d) Transfer The fan installed between the ink jet printing unit and the pressure roller was operated to blow air against the ink image on the surface of the intermediate transfer body. Then, the intermediate transfer body and surface-coated print paper with little ink absorbing capability (NPi coat paper of A-size of Nippon Paper make, 1000-sheet weight: 40.5 kg) were brought into contact with each other by the pressure roller to transfer the ink image to the print paper. Neither beading nor bleeding was observed on the image on the print paper and the quality of the transferred image was good.

Then, a small amount of residual ink on the intermediate transfer body was removed by placing a wet morton roller against the transfer body.

Embodiment 3

(a) Surface Modification of Transfer Body

As an intermediate transfer body this embodiment used an aluminum drum coated with silicone rubber with a hardness of 80 degrees (KE24 of Shinetsu Kagaku make) to a thickness of 0.5 mm. First, the surface of the intermediate transfer body was modified under the following conditions by using an atmospheric pressure plasma processor 3 (ST-7000 of Keyence make).

Irradiation distance: 5 mm

Plasma mode: Metal

Processing rate: 75 mm/sec (b) Application of Ink Viscosity Increasing Component Next, fluorinated surfactant (Surflon S-141 of Seimi Chemical make) was applied to the surface of the intermediate transfer body whose surface was modified using the roll coater. Then, a 5% by mass high molecular coagulant (C577S of Mitsui Cytec make) solution in water was applied using the roll coater.

(c) Forming of Image on Intermediate Transfer Body

Next, the ink jet printing unit (nozzle density: 1200 dpi, ejection volume: 4 pl, drive frequency: 8 kHz) was operated to form a mirror-inverted character image of four color inks on the intermediate transfer body. Here, the ink used has the following composition. When the ink image was formed on the intermediate transfer body, it was retained well and no beading resulted.

The following pigments: 4 parts

Black: C.I. Food Black 2

Cyan: C.I. Direct Blue 199

Magenta: C.I. Acid Red 289

Yellow: C.I. Acid Yellow 23

Glycerin: 10 parts

Ethylene glycol: 5 parts

Surfactant (Acetylenol EH of Kawaken Fine Chemicals make): 1 part

Ion-exchange water: 80 parts (d) Transfer

The heat roller (surface temperature: 60° C.) held in contact with the back of the intermediate transfer body was activated to heat the ink image on the intermediate transfer body, accelerating evaporation of water from the image. Then, the intermediate transfer body and surface-coated print paper with little ink absorbing capability (NPi coat paper of A-size of Nippon Paper make, 1000-sheet weight: 40.5 kg) were brought into contact with each other by the pressure roller to transfer the ink image to the print paper. No beading was observed in the image on the print paper and the quality of the transferred image was good.

Next, a small amount of residual ink on the intermediate transfer body was removed by placing a wet morton roller against the transfer body.

Embodiment 4

(a) Surface Modification of Transfer Body

In this embodiment, a polyester film 0.5 mm thick was undercoated with a silane coupling agent (KBM503 of Shinetsu Kagaku make) and then coated with silicone rubber with a hardness of 40 degrees (KE12 of Shinetsu Kagaku make) to a thickness of 0.5 mm to form a surface layer of the intermediate transfer body. The intermediate transfer body surface layer was modified under the following conditions using a parallel-plate type plasma processor.

Irradiation distance: 5 mm

Gas flow: 100 sccm (standard cc/min)

Pressure: 0.08 torr (1.066 Pa)

Power: 1,200 W

Processing time: 30 sec

Next, this surface layer was wound on an aluminum drum to form an intermediate transfer body.

(b) Application of Ink Viscosity Increasing Component

Next, 1% of fluorinated surfactant (Surflon S-141 of Seimi Chemical make) was added to a 10% by mass calcium chloride dihydrate solution in water, and this solution was coated to the surface of the intermediate transfer body using the roll coater:.

(c) Forming of Image on Intermediate Transfer Body

Next, the ink jet printing unit (nozzle density: 1200 dpi, ejection volume: 4 pl, drive frequency: 10 kHz) was operated to form a mirror-inverted character image of four color inks on the intermediate transfer body which was coated with an ink viscosity increasing component. The ink used is the same as the one used in Embodiment 2. When the ink image was formed on the intermediate transfer body, it was retained well and neither beading nor bleeding resulted.

(d) Transfer

The fan installed between the ink jet printing unit and the pressure roller was operated to blow air against the ink image on the surface of the intermediate transfer body. Then, the intermediate transfer body and surface-coated print paper with little ink absorbing capability (NPi coat paper of A-size of Nippon Paper make, 1000-sheet weight: 40.5 kg) were brought into contact with each other by the pressure roller to transfer the ink image to the print paper. Neither beading nor bleeding was observed on the image on the print paper and the quality of the transferred image was good.

Then, a small amount of residual ink on the intermediate transfer body was removed by placing a wet morton roller against the transfer body.

Embodiment 5

(a) Surface Modification of Transfer Body

In this embodiment, a polyester film 0.5 mm thick was undercoated with a silane coupling agent (KBM503 of Shinetsu Kagaku make) and then coated with silicone rubber with a hardness of 40 degrees (KE12 of Shinetsu Kagaku make) to a thickness of 0.5 mm to form a surface layer of the intermediate transfer body. The intermediate transfer body surface layer was modified under the following conditions using a parallel-plate type plasma processor. The modified intermediate transfer body surface layer was then mounted on a surface of an aluminum drum.

Irradiation distance: 5 mm

Gas flow: 100 sccm

Pressure: 0.08 torr (1.066 Pa)

Power: 1,200 W

Processing time: 30 sec

Further, the surface of the intermediate transfer body was modified under the following conditions by using an atmospheric pressure plasma processor (ST-7000 of Keyence make).

Irradiation distance: 5 mm

Plasma mode: Metal

Processing rate: 200 mm/sec (b) Application of Ink Viscosity Increasing Component Next, the intermediate transfer body whose surface was modified was coated with an ink viscosity increasing component using a roll coater. As the ink viscosity increasing component, a 10% by mass aluminum chloride hexahydrate solution in water to which 1% of fluorinated surfactant (Surflon S-141 of Seimi Chemical make) was added was used.

(c) Forming of Image on Intermediate Transfer Body

Next, the ink jet printing unit (nozzle density: 1200 dpi, ejection volume: 4 pl, drive frequency: 12 kHz) was operated to form a mirror-inverted character image of four color inks on the intermediate transfer body which was coated with an ink viscosity increasing component. The ink used is the same as the one used in Embodiment 2. When the ink image was formed on the intermediate transfer body, it was retained well and neither beading nor bleeding resulted.

(d) Transfer

The fan installed between the ink jet printing unit and the pressure roller was operated to blow air against the ink image on the surface of the intermediate transfer body. Then, the intermediate transfer body and surface-coated print paper with little ink absorbing capability (NPi coat paper of A-size of Nippon Paper make, 1000-sheet weight: 40.5 kg) were brought into contact with each other by the pressure roller to transfer the ink image to the print paper. Neither beading nor bleeding was observed on the image on the print paper and the quality of the transferred image was good.

Then, a small amount of residual ink on the intermediate transfer body was removed by placing a wet morton roller against the transfer body.

COMPARATIVE EXAMPLE 1

Image printing was done in the same way as in Embodiment 1, except that the intermediate transfer body was not subjected to the surface modification. As a result, the ink image on the intermediate transfer body was deformed and the image quality on a print medium after transfer was so poor that small characters were not readable.

COMPARATIVE EXAMPLE 2

Image printing was done in the same way as in Embodiment 5, except that the intermediate transfer body used a surface material of butyl rubber with no releasing capability. As a result, the transfer rate was degraded and, to realize a good quality image obtained in Embodiment 5, about 1.5 times the ink volume spent in Embodiment 5 was required. The time needed to remove water by the air blowing operation from the image forming to the transfer was 1.6 times what it took in Embodiment 5. Further, the image of this example had a slightly larger dot gain than that of Embodiment 5 and the resolution was degraded.

4. Example of Control System and Control Procedure

In constructing the image forming apparatus of FIG. 1 using various units employed in one of the above embodiments, the control system may be formed as described below.

Figure 2:
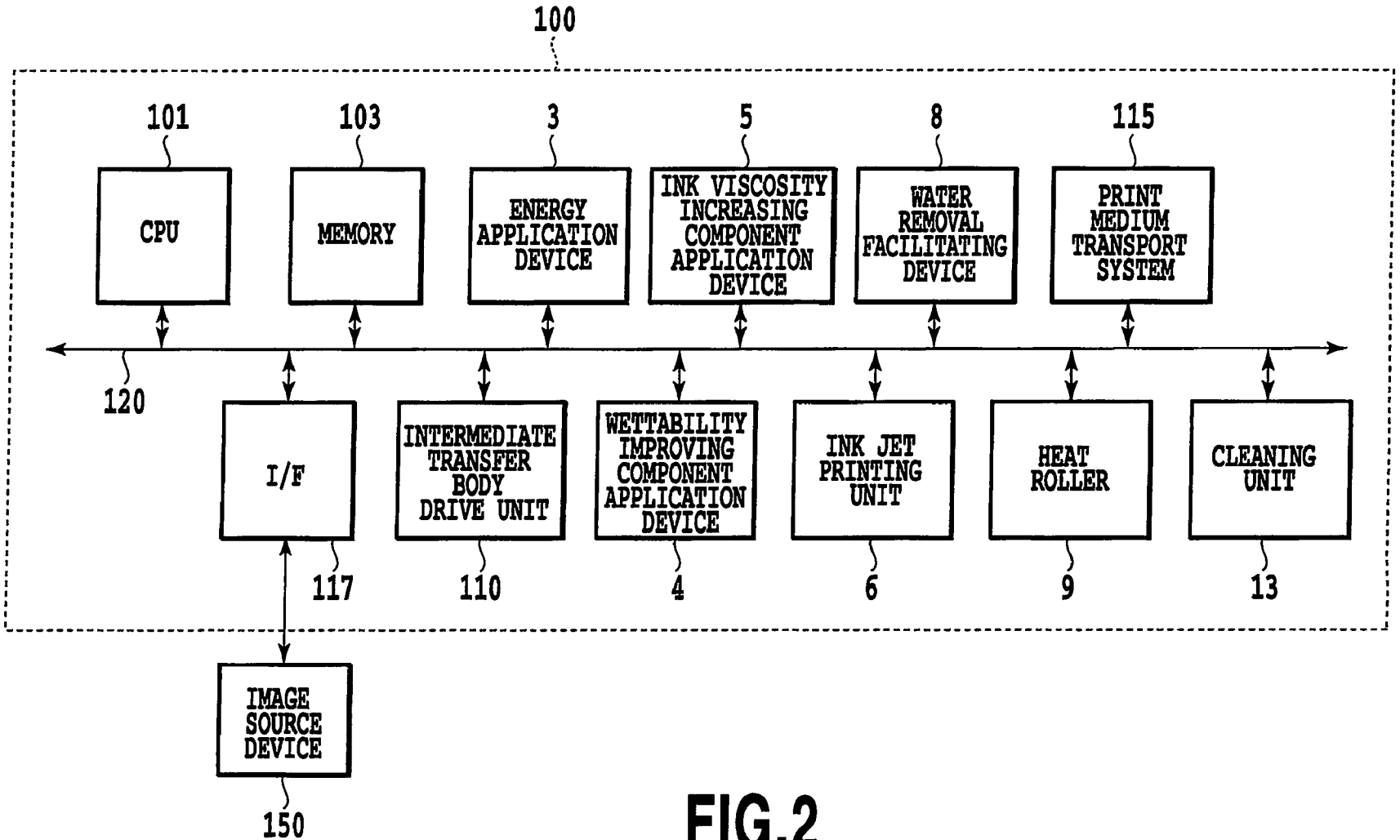
FIG. 2 is a block diagram showing an example control system constructed to control the image forming apparatus of FIG. 1.

FIG. 2 shows an example configuration of a control system that may be built for the image forming apparatus of FIG. 1. In the image forming apparatus generally denoted 100, reference number 101 represents a CPU, a main control unit for the entire system. Denoted 103 is a memory including a ROM storing an operating system of CPU 101 and a RAM used to temporarily store a variety of data and to process image data and other works. Denoted 117 is an interface to send and receive data and commands to and from an image source device 150, a source of image data which may take a form of a host computer or others.

Designated 110 is a drive unit for driving the intermediate transfer body 1 in the processes (a) to (d). Reference number 115 represents a transport system for a print medium 10 and includes drive units for the pressure roller 11 and the fixing rollers 12. A bus line 120 interconnects the aforementioned components and also an energy application device 3, which may take one of the forms described in the above embodiments, an application device 4, an application device 5, an ink jet printing unit 6, a water removal facilitating device 8, a heat roller 9 and a cleaning unit 13 and sends control signals from the CPU 101. These components may be provided with status sensors so that detected signals are transmitted to the CPU 101 through the bus line 120.

Figure 3:
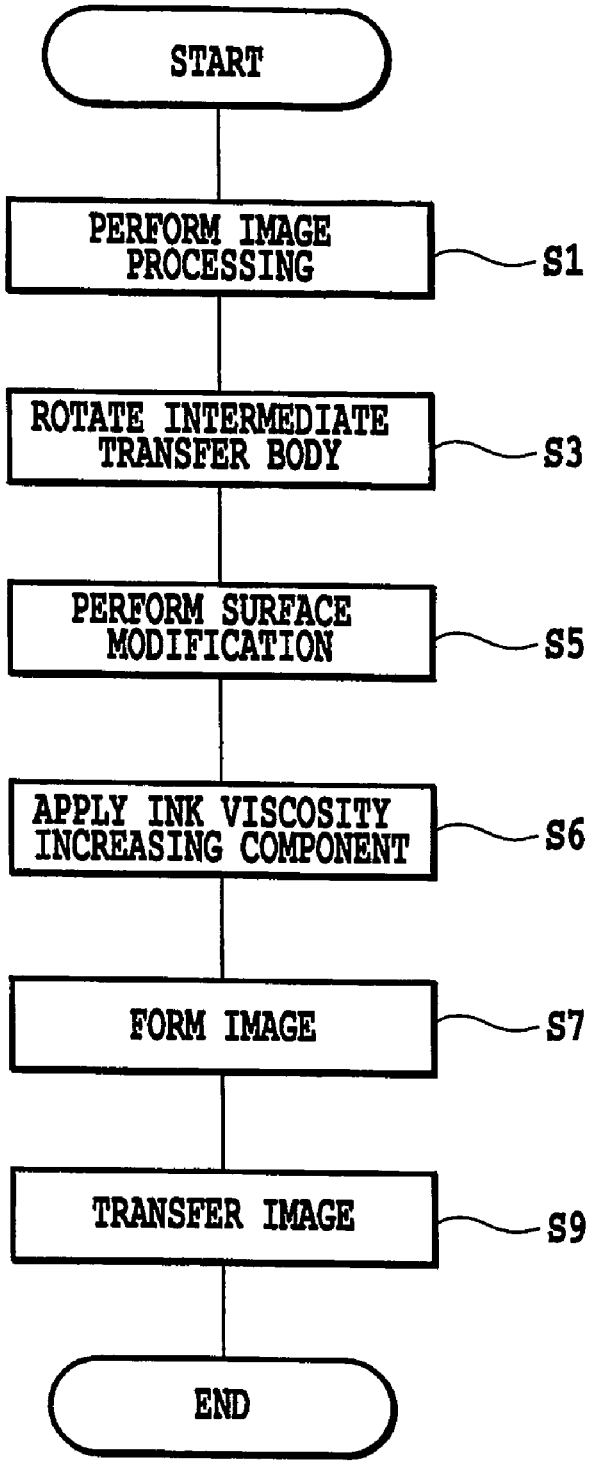
FIG. 3 is a flow chart showing an example sequence of image forming processing using the control system of FIG. 2.

FIG. 3 shows a flow chart showing an example procedure of image forming process using the above control system.

When image data is received from the image source device 150 and the printing of that image data is specified, predetermined image processing is performed on the image data so that the ink jet printing unit 6 can form an image (step S1). If the image data sent from the image source device is not mirror-inverted data, this image processing can include the inversion processing.

When the ink jet printing unit 6 is ready to print, the intermediate transfer body 1 is rotated (step S3), which is followed by the driving of the energy application device 3 associated with the surface modification process (X) or (a) (.step S5; this can include the driving of the application device 4 for applying a surfactant), followed by the driving of the application device 5 associated with the process (b) for applying the ink viscosity increasing component to the intermediate transfer body 1 (step S6), followed by the driving of the ink jet printing unit 6 associated with the image forming process (Y) or (c) (step S7), followed by the driving of the water removal facilitating device 8, the heat roller 9, the print medium transport system 115 and the cleaning unit 13, all associated with the process (Z) or (b) for transferring the ink image onto the print medium. These components are synchronously driven to ensure that the intermediate transfer body surface is modified for good image forming and that the position of the formed image and the transferred image position on the print medium are aligned correctly. If the ink jet printing unit 6 is of a serial printing type, the image forming is done by alternating the main scan of the ink jet head and the rotation over a predetermined distance of the intermediate transfer body 1. When the processing of the specified amount of image data is completed, this procedure is exited.

While in the above procedure it is assumed that the surface modification through energy application is performed at all times in the image forming processing, it may be performed at an appropriate timing. That is, it may be performed prior to the image forming processing or its timing may be managed based on the time spent and printed data volume, or it may be performed independently of the image forming processing by monitoring a degradation of the intermediate transfer body surface. These may be combined as desired. Further, the time and degree of surface modification performed can also be set appropriately. For example, the surface modification may be performed for a few complete rotations of the intermediate transfer body 1.

5. Others

It is not essential in this invention that all the processes (a)-(d) are executed during the image forming processing or that the device is equipped with all means to execute the associated processes. That is, if the intermediate transfer body which is surface-modified through energy application can keep its performance for a long period, this invention also includes an image forming method that performs processes (c) to (d) or processes (b) to (d) by using an intermediate transfer body which is surface-modified in advance by, for instance, the process (a) described in connection with Embodiment 4, and an image forming apparatus equipped with means to execute these processes. In other words, the only requirement is that, prior to the image formation on the intermediate transfer body, the intermediate transfer body be surface-modified properly. So, the surface modifying process does not have to be performed immediately before the application of the ink viscosity increasing component to the intermediate transfer body or the formation of an ink image on the intermediate transfer body. Nor does the surface modifying means have to be provided in the image forming apparatus. That is, the intermediate transfer body may be removably mounted on a mounting means in the image forming apparatus. Or a surface-modified intermediate transfer body may be mounted on the mounting means. In addition to these, this invention also includes a method of modifying the surface of the intermediate transfer body, suited for executing the image forming method that performs the above process (c) or processes (b) and (c); the intermediate transfer body; and a method and a device that perform image forming by using the intermediate transfer body.

In this invention the application of the ink viscosity increasing component in the above process (b) is not essential and may be omitted. To enhance the retainability of an ink image on the intermediate transfer body, however, the process (b) should preferably be performed. The process (b), when executed, improves the retainability of an ink image on the intermediate transfer body, which in turn provides a better quality of a transferred ink image on a print medium than that obtained without performing the process (b).

II. Second Embodiment

1. Characteristic Construction

Next, a second embodiment of this invention will be explained. This embodiment is characterized in that the intermediate transfer body has a surface made of a material containing fluorine compound or silicone compound and that the surface is modified by subjecting it to plasma processing and applying a surfactant to it. Following the surface modification, the same process as that of the first embodiment is performed, i.e., forming an image on the intermediate transfer body and then transferring it onto a print medium. Thus, an image forming apparatus can have almost the same construction as that shown in FIG. 1. The following description therefore centers on differences from the first embodiment.

The intermediate transfer body 1 of this example has a surface layer 2 which is already subjected to a hydrophilic surface treatment through plasma processing and application of a surfactant. An atmospheric pressure plasma processor 3 performs an additional surface modification treatment on the surface layer 2 at appropriate intervals along with the surfactant application device 4 to maximize the surface modification effect according to the number of printed sheets.

To remove any excess surfactant supplied from the application device 4, a cleaning unit may be installed between the surfactant application device 4 and the ink viscosity increasing component application device 5. If the interval of the additional surface modification treatment can be set long, the cleaning unit 13 for cleaning the surface of the intermediate transfer body after the ink image transfer may also be used to remove the excess surfactant. In that case, the device may be idled for one process (which, in the example of FIG. 1, corresponds to one rotation of the intermediate transfer body 1).

As for the subsequent processes, this example has the similar construction to the first embodiment in that the ink viscosity increasing component is applied from the application device 5, with other necessary units installed for executing the subsequent processes.

The image forming apparatus of this embodiment is characterized by a surface modification process in which the surface of the intermediate transfer body 1 is modified through plasma processing and a surfactant application (hereinafter called a process (X')). This image forming apparatus is similar to the first embodiment in that it includes means to implement a process of forming an ink image on the intermediate transfer body by the ink jet printing method and a process of transferring the ink image formed on the intermediate transfer body 1 onto a print medium, and that means to implement a process of applying an ink; viscosity increasing component prior to the image forming can preferably be provided. The process (X') and the means to implement the process (X') will be explained in detail by way of example.

The process (X') is a process to modify the surface of the intermediate transfer body by performing the plasma processing and the surfactant application operation on the surface whose material contains at least a fluorine compound or silicone compound.

A preferred condition for the material of the surface layer 2 is that it contain one of fluorine compound and silicone compound. These compounds have an excellent releasability with respect to ink and therefore provide a high efficiency of transferring an ink image. The fluorine compound and the silicone compound described here include fluorine oil and silicone oil which are an important material capable of enhancing the transfer efficiency in particular. The releasability is as defined in the first embodiment. An example of the surface layer 2 is also similar to the one explained in connection with the first embodiment.

The process (X') modifies the surface layer 2 of the intermediate transfer body 1 constructed as described above through plasma processing and surfactant application. The materials with an excellent releasability, such as fluorine compound and silicon compound, generally exhibit a low critical surface tension and thus repel liquids such as ink and ink viscosity increasing component. Under this condition an ink image cannot be formed on the intermediate transfer body. To cope with this situation, the surface modification through plasma processing and surfactant application is performed to minimize the ink repelling tendency. The plasma processing is generally performed at an atmospheric pressure or reduced pressure and either of the atmospheric and reduced pressure types can be used without a problem. The means that performs the plasma processing at the atmospheric pressure is more advantageous because it can be installed in the image forming apparatus like the plasma processor 3 of FIG. 1 and perform additional surface modification processing according the surface characteristic degradation the severity of which depends on the number of printed sheets. The plasma processing described here includes a corona discharging that activates oxygen in the atmosphere to create hydroxyl groups on the surface.

The surface modification is completed by applying a surfactant to the surface following the plasma processing. With these processing, the surface modification effect can be maintained for a long period of time. The surfactant used may include common surfactants, such as cationic surfactant, anionic surfactant, non-ionic surfactant, amphoteric surfactant, fluorinated surfactant and silicone surfactant.

The means for applying the surfactant may preferably be ones that perform a roll coating, a doctor coating and a spraying because these can apply the agent continuously. Depending on the construction of the image forming apparatus, a dip coating which is a form of batch processing may also be employed.

This surface modification means not only performs the hydrophilic surface treatment but has an effect of keeping from deteriorating, or of improving, the efficiency of transferring an ink image formed on the intermediate transfer body to a print medium at a later process.

The hydrophilic surface treatment that uses plasma processing at reduced pressure and a surfactant application is disclosed in Japanese Patent Application Publication No. 61-036783 (1986) as being limited to silicone rubber as an object of application. The present invention, on the other hand, uses an intermediate transfer body which is not only made hydrophilic but also provided with an improved ink transferability. This invention therefore clearly differs from the above reference both in the philosophy and in the limitations on a selected material and :an ambient pressure for the plasma processing.

A mechanism of how these selected materials and selected surface modification means can produce a desirable effect has not yet been fully understood. However, where fluorine or silicone oil component exists, it seems apparent that the hydrophilic surface treatment of this invention realizes a remarkable combination of the capability of making the surface hydrophilic and the capability of maintaining or improving the transferability and that, once the processing is performed, these effects tend to last for a long period. This suggests that, in addition to the generally known chemical action of the plasma treatment (introduction of hydrophilic groups on the surface) which makes hydrophilic at least a part of the rubber component, filler component and oil component of the surface layer, a physical action (surface roughening) changes a part of a rubber structure to promote the oil component movement on the surface. Further, since the surfactant application causes a surfactant to adsorb on the surface that was raised to a high-energy state by the plasma treatment, hydrophilic groups are formed on the surface, making the surface a more stable hydrophilic surface, with the result that the surface can exhibit the hydrophilic characteristic for a very long period. Actually, there is a tendency observed that there is a strong correlation between the hydrophilic property and the plasma deactivation time. That is, the shorter the time interval between the plasma treatment and the application of a surfactant, the greater the effect obtained.

The surface-modified intermediate transfer body generally may be removed of excess surfactant by a washing means before being supplied to the next process. Applying a treatment such as heating before washing may enhance hydrophilicity in a short period of time. In the image forming apparatus of FIG. 1, such a cleaning means may be installed between the application device 4 and the application device 5.

The surface modification may be performed on the intermediate transfer body 1 at all times or at predetermined intervals in an image forming apparatus that has a plasma processor 3 and a surfactant application device 4 as in the embodiment of FIG. 1. Or an intermediate transfer body with its surface already modified may be used in an image forming apparatus in which the plasma processor 3 and the surfactant application device 4 are not installed. Alternatively, they may be combined. That is, an intermediate transfer body with its surface modified in advance is used, the plasma processor 3 and the surfactant application device 4 are installed independently or in combination in the image forming apparatus, and then an additional surface modification treatment is performed on the surface layer 2 at an appropriate interval according to the number of printed sheets to maximize the surface modification effect.

In either case the technical features of this embodiment are summarized into two points: that an image forming performance is improved by performing a hydrophilic surface treatment on the intermediate transfer body having fluorine or silicone compound that can offer a high transferability; and that the image forming on the intermediate transfer body is done by an ink jet printing. Main effects produced by the realization of high transferability are a reduction in ink volume applied to the intermediate transfer body and an improved cleaning performance. The above effects, the effects produced by the image forming using the ink jet printing, and the effects produced by the optional application of ink viscosity increasing component are similar to those obtained in the first embodiment.

The surface containing a fluorine compound or silicone compound, which is basically employed in this embodiment, is generally water repellent and, if not treated, will repel liquids such as ink, making the forming and holding of an ink image on the surface difficult. The reason that this invention or embodiment performs the surface modification through plasma treatment and surfactant application is to overcome this very problem, i.e., to allow an ink image to be formed and held on the surface with a high ink transfer efficiency. By subjecting the intermediate transfer body having a surface containing a fluorine or silicon compound with high ink transferability to the surface modification processing consisting of the plasma treatment and surfactant application as described above, the surface of the intermediate transfer body can be made suited to ink holding while maintaining the inherently high ink transfer efficiency.

In this embodiment it is essential that the surfactant application is performed after the plasma treatment. This is because the adsorption of a surfactant on the surface, which was raised to a high energy state by the plasma treatment, is considered to introduce hydrophilic groups on the surface thereby making the hydrophilic surface more stable and maintaining the hydrophilic property of the surface for a very long period.

In this respect, this embodiment differs from the first embodiment which permits an application of ink viscosity increasing component or, prior to this, an application of surfactant for improved wettability. That is, this embodiment is characterized in that the surfactant application is linked with the plasma treatment on the intermediate transfer body, with the surfactant having a function of changing the surface characteristic of the intermediate transfer body. On the other hand, the first embodiment is characterized in that the surfactant application is linked with, and is performed prior to, the process of applying ink and ink viscosity increasing component, with the surfactant having a function of providing an affinity between the intermediate transfer body and ink or ink viscosity increasing component.

2. Example Embodiments

Next, example embodiments will be explained in detail for each printing process. In the following explanations, "part" and "%" are expressed in mass terms unless otherwise specifically stated.

Embodiment 6

(a) Surface Modification of Transfer Body

As an intermediate transfer body this embodiment used an aluminum drum coated with silicone rubber with a hardness of 40 degrees (KE12 of Shinetsu Kagaku make) to a thickness of 0.2 mm. First, the surface of the intermediate transfer body was modified under the following conditions by using an atmospheric pressure plasma processor 3 (ST-7000 of Keyence make).

Irradiation distance: 5 mm

Plasma mode: High

Processing rate: 100 mm/sec

Next, the intermediate transfer body was immersed for 10 seconds in a 3% surfactant solution which was made by diluting a commercially available neutral detergent composed of sodium alkylbenzenesulfonate with pure water. The drum was then washed with water and dried.

(b) Forming of Image on Intermediate Transfer Body

Next, a 5% by mass high molecular coagulant (C577S of Mitsui Cytec make) solution in water was applied to the surface of the intermediate transfer body using the roll coater. Then, the ink jet printing unit (nozzle density: 1200 dpi (dots/inch, reference value), ejection volume: 4 pl, drive frequency: 12 kHz) was operated to form a mirror-inverted character image of aqueous inks on the intermediate transfer body. The ink used has the following composition. When the ink image was formed on the intermediate transfer body, no beading resulted.

The following dyes: 4 parts

Black: C.I. Food Black 2

Glycerin: 10 parts

Diethylene glycol: 5 parts

Surfactant (Acetylenol EH of Kawaken Fine Chemicals make): 1 part

Ion-exchange water: 80 parts (c) Transfer

Following the above processes, the intermediate transfer body and surface-coated print paper with little ink absorbing capability (NPi coat paper of A-size of Nippon Paper make, 1000-sheet weight: 40.5 kg) were brought into contact with each other by the pressure roller to transfer the ink image to the print paper. No beading was observed on the image on the print paper and the quality of the transferred image was good. There was almost no residual ink on the intermediate transfer body surface, which in the current state was able to receive the next image without causing any problem.

Embodiment 7

(a) Surface Modification of Transfer Body

As an intermediate transfer body this embodiment used an aluminum drum coated with silicone rubber with a hardness of 60 degrees (KE30 of Shinetsu Kagaku make) to a thickness of 0.2 mm. First, the surface of the intermediate transfer body was modified under the following conditions by using an atmospheric pressure plasma processor 3 (Plasma Atom Handy of Nippon Paint make).

Irradiation distance: 1 mm

Plasma mode: Standard

Processing rate: 10 mm/sec

Next, the intermediate transfer body was coated for 10 seconds with a spray of a 1% surfactant solution which was made by diluting a silicone surfactant (Silwet L-77 of Nippon Unicar make) with pure water. The drum was then washed with water and dried.

(b) Forming of Image on Intermediate Transfer Body

Next, the surface of the intermediate transfer body was applied by a roll coater with a treatment liquid, which was made by adding 0.5% fluorinated surfactant (Surflon S-141 of Seimi Chemical make) to a 10% by mass calcium chloride dihydrate solution in water. Then, the ink jet printing unit (nozzle density: 1200 dpi, ejection volume: 4 pl, drive frequency: 10 kHz) was operated to form a mirror-inverted character image of 4 color inks on the intermediate transfer body. The inks used have the following compositions. When the ink image was formed on the intermediate transfer body, neither beading nor bleeding resulted.

The following pigments: 3 parts

Black: Carbon Black (MCF88 of Mitsubisi Kagaku make)

Cyan: Pigment Blue 15

Magenta: Pigment Red 7

Yellow: Pigment Yellow 74

Styrene/acrylic acid/ethyl acrylate copolymer (acid value: 240, weight-averaged molecular weight: 5,000): 1 part Glycerin: 10 parts Ethylene glycol: 5 parts Surfactant (Acetylenol EH of Kawaken Fine Chemicals make): 1 part Ion-exchange water: 80 parts (c) Transfer First, the fan installed between the ink jet printing unit and the pressure roller was operated to blow air against the ink image on the intermediate transfer body. Then, the intermediate transfer body and surface-coated print paper with little ink absorbing capability (NPi coat paper of A-size of Nippon Paper make, 1000-sheet weight: 40.5 kg) were brought into contact with each other by the pressure roller to transfer the ink image to the print paper. Neither beading nor bleeding was observed on the image on the print paper and the quality of the transferred image was good.

Embodiment 8

In the following, the image printing method of this embodiment will be described for each process.

(a) Surface Modification of Transfer Body

As a surface layer of an intermediate transfer body this embodiment used an aluminum plate 0.2 mm thick, coated with a fluororubber (Aflas 150C of Asahi Glass make) to a thickness of 0.5 mm. First, the surface of the intermediate transfer body was modified under the following conditions by using an atmospheric pressure plasma processor (AT-T02 of Sekisui Kagaku make).

Irradiation distance: 2 mm

Input voltage: 240 V

Frequency: 10 kHz

Introduced gas: Wet air

Processing time: 30 sec

The intermediate transfer body surface was then coated by a sponge roller with a 5% surfactant solution which was made by diluting a commercially available surfactant of alkyl sulfate ester with pure water. It was left standing for 60 seconds and then washed with water and dried.

Then, the intermediate transfer body surface layer was wound around an aluminum drum as a support to form an intermediate transfer body.

(b) Forming of Image on Intermediate Transfer Body

Next, a fluorinated surfactant (Surflon S-141 of Seimi Chemical make) was applied to the surface of the intermediate transfer body using a roll coater.

Next, a 10% by mass aluminum chloride hexahydrate solution in water was applied by a roll coater. Then, the ink jet printing unit (nozzle density: 1200 dpi, ejection volume: 4 pl, drive frequency: 8 kHz) was operated to form a mirror-inverted character image of 4 color inks on the intermediate transfer body. The inks used are the same as used in Embodiment 2. When the ink image was formed on the intermediate transfer body, neither beading nor bleeding resulted.

(c) Transfer

First, the heat roller (surface temperature: 60° C.) installed in contact with the back of the intermediate transfer body was operated to accelerate evaporation of water from the ink image on the intermediate transfer body. Then, the intermediate transfer body and surface-coated print paper with little ink absorbing capability (NPi coat paper of A-size of Nippon Paper make, 1000-sheet weight: 40.5 kg) were brought into contact with each other by the pressure roller to transfer the ink image to the print paper. No beading was observed on the image on the print paper and the quality of the transferred image was good.

Then, a small amount of residual ink on the intermediate transfer body was removed by placing a wet morton roller against the transfer body. The residual ink was easily removed.

Embodiment 9

(a) Surface Modification of Transfer Body

In this embodiment, as an intermediate transfer body a polyester film 0.5 mm thick was undercoated with a silane coupling agent (KBM503 of Shinetsu Kagaku make) and then coated with fluorosilicone rubber with a hardness of 60 degrees (FE361-U of Shinetsu Kagaku make) to a thickness of 0.2 mm to form a surface layer of the intermediate transfer body. This surface layer of the intermediate transfer body was modified under the following conditions using a parallel-plate plasma processor.

Irradiation distance: 5 mm

Gas flow: 100 sccm (standard cc/min)

Pressure: 0.08 torr (1.066 Pa)

Power: 1,200 W

Processing time: 30 sec

Then, fluorinated surfactant (Surflon S-141 of Seimi Chemical make) was diluted with pure water to produce a 10% surfactant solution, which was applied to the surface layer of the intermediate transfer body using a sponge roller. The surface layer was left standing for 6.0 seconds and then washed with water and dried.

The surface layer was then wound on an aluminum drum as a support to form an intermediate transfer body.

(b) Forming of Image on Intermediate Transfer Body

The ink jet printing unit (nozzle density: 1200 dpi, ejection volume: 4 pl, drive frequency: 5 kHz) was operated to form a mirror-inverted character image of 4 color inks on the intermediate transfer body whose surface was applied with an ink viscosity increasing component. The inks used are the same as used in Embodiment 6. When the ink image was formed on the intermediate transfer body, neither beading nor bleeding resulted.

(c) Transfer

The fan installed between the ink jet printing unit and the pressure roller was operated to blow air against the ink image on the surface of the intermediate transfer body. Then, the intermediate transfer body and surface-coated print paper with little ink absorbing capability (NPi coat paper of A-size of Nippon Paper make, 1000-sheet weight: 40.5 kg) were brought into contact with each other by the pressure roller to transfer the ink image to the print paper. Neither beading nor bleeding was observed on the image on the print paper and the quality of the transferred image was good.

The intermediate transfer body of this embodiment exhibited a good image forming capability even after six months of storage.

3. Examples of Control System and Control Procedure

When the image forming apparatus of FIG. 1 is constructed using units and components employed in the above Embodiment 4 to 6, a control system such as shown in FIG. 2 may be used (the energy application device 3 of FIG. 2 is an atmospheric pressure plasma processor that can take one of the forms of the above embodiments and the application device 4 is a surfactant application device).

Figure 4:
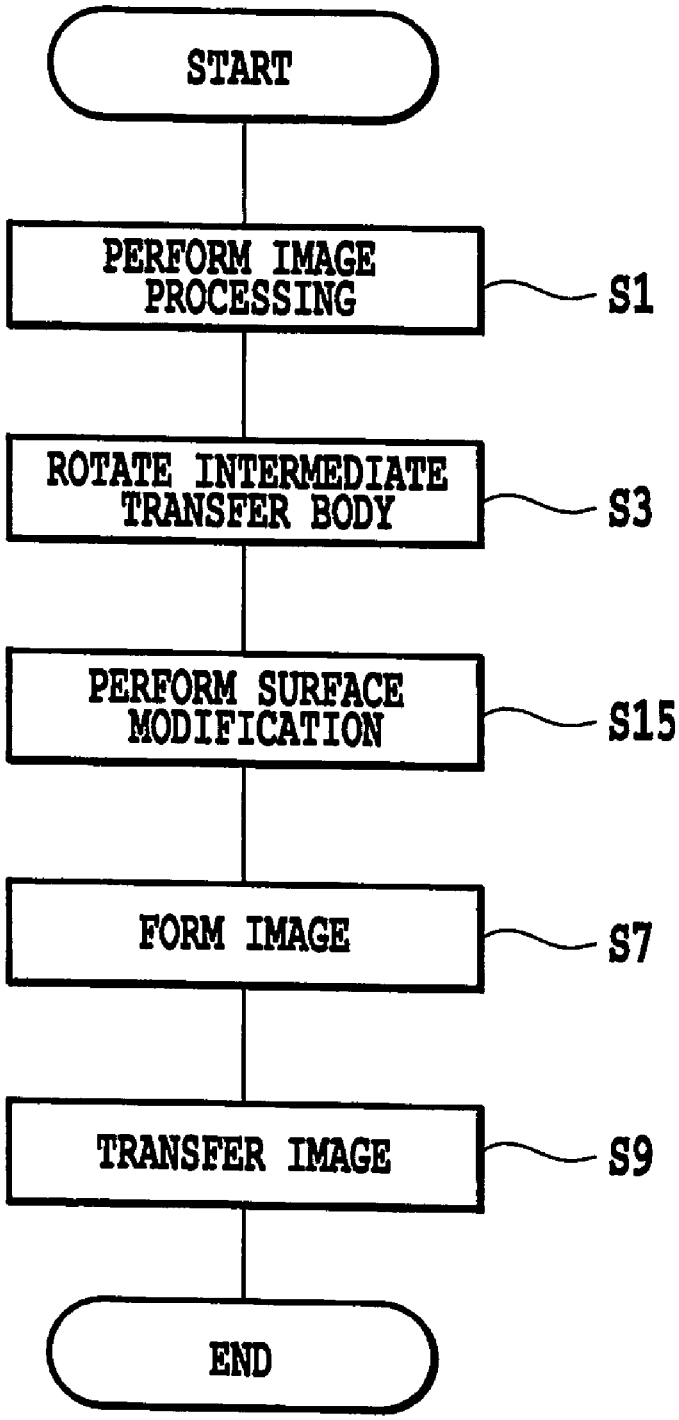
FIG. 4 is a flow chart showing an example sequence of image forming processing according to a second embodiment of this invention.

FIG. 4 is a flow chart showing an example image forming procedure. Here those steps that can be executed in a way similar to those shown in FIG. 3 associated with the first embodiment are assigned like reference numbers.

This procedure is characterized by step S15 that drives the atmospheric pressure plasma processor 3 and the surfactant application device 4 during the surface modification process (X').

Figure 5:
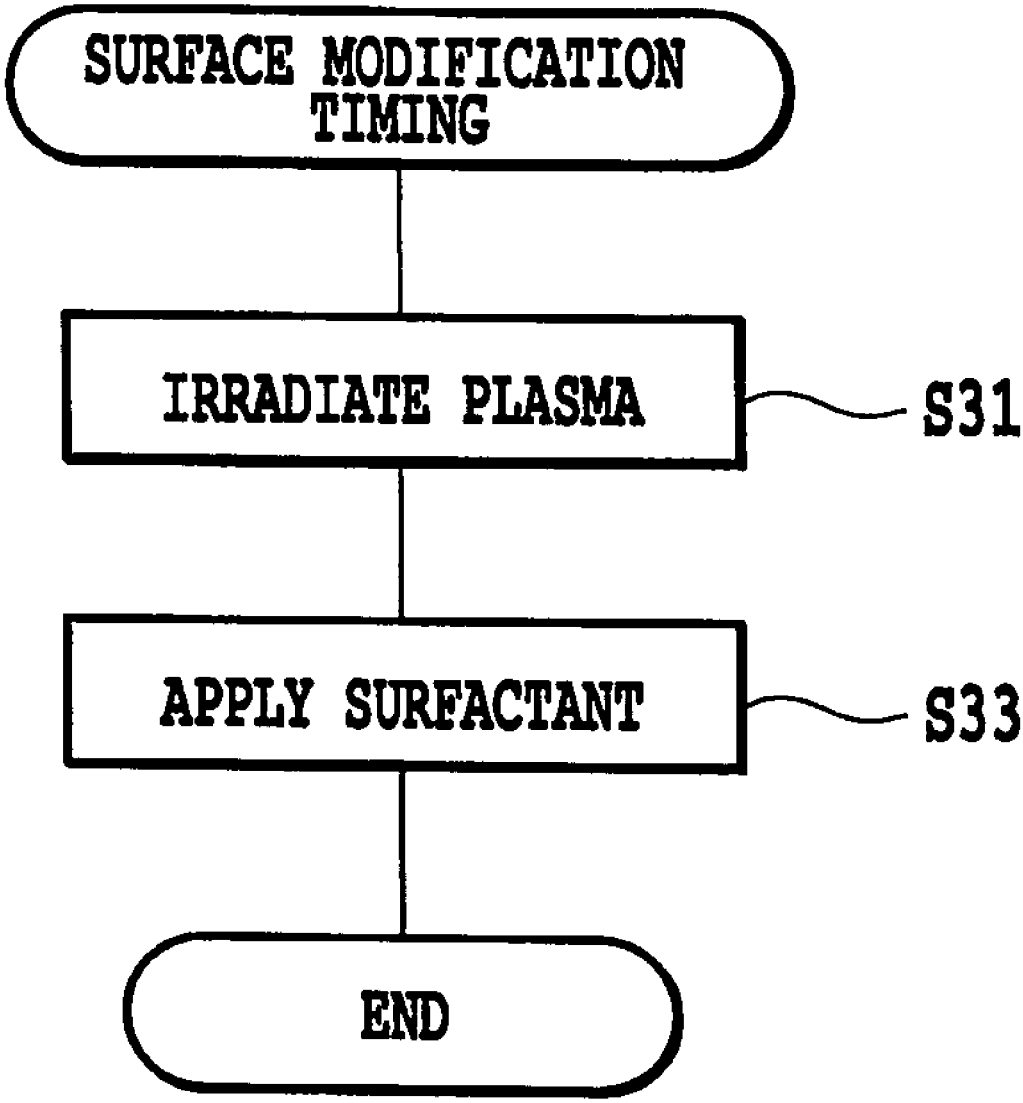
FIG. 5 is a flow chart showing an essential part of the sequence of image forming processing according to the second embodiment of this invention.

FIG. 5 shows an example of the surface modification procedure, which, when initiated, causes the atmospheric pressure plasma processor 3 to perform plasma processing (step S31) and the application device 4 to apply a surfactant (step S33). The execution duration of this procedure or the degree of surface modification can be determined appropriately. For example, this processing may be set to be performed for a few rotations of the intermediate transfer body 1.

4. Others

With the second embodiment, it is not essential to execute all the processes (a) to (c) during the image printing processing described in connection with Embodiment 6-9 or to have all means in the image forming apparatus to execute these processes. Further, the surface: modifying means constructed by the plasma processor 3 and the surfactant application device 4 does not have to be provided in the image forming apparatus. This invention is also characterized by an intermediate transfer body surface modifying method suited to executing the image forming method that performs the processes (b) and (c) associated with Embodiments 6-9. The invention is also characterized by the intermediate transfer body.

Further, in performing the surface modification processing, the plasma treatment and the surfactant application do not have to be combined but they may be chosen as necessary. For example, if, after execution of both processes, a satisfactory surface modifying effect can be maintained by performing only one of the processes thereafter, it is possible to select only one of them for execution.

As described above, this invention provides an image forming method which has no limitation on the kind of print medium and can output different digital images on different pages. This invention can also makes it possible to produce a small number of printed copies with high quality and low cost even if the print medium is a glossy material.

The invention claimed is:

1. An image forming method comprising the steps of:

applying a liquid, for coagulating a colorant of ink, onto an intermediate transfer body having a surface to which a hydrophilic treatment, where energy is applied to the surface, has been performed;

forming an image by ejecting ink from an ink jet head onto the intermediate transfer body on which the liquid has been applied; and transferring the image formed on the intermediate transfer body to a recording medium.

2. An image forming method according to claim 1, wherein the surface of the intermediate transfer body contains at least one of a fluorine compound and a silicone compound.

3. An image forming method according to claim 1, wherein the surface of the intermediate transfer body is formed of an elastic material with a hardness of between 10 and 100 degrees.

4. An image forming method according to claim 1, wherein the hydrophilic treatment comprises plasma processing.

5. An image forming method according to claim 1, wherein the liquid contains metal ions as a component for coagulating the colorant.

6. An image forming method according to claim 1, further comprising a step of applying a wettability improving liquid, for improving the wettability of the surface of the intermediate transfer body, prior to applying the liquid.

7. An image forming method according to claim 1, further comprising a step of promoting a removal of water from the ink on the intermediate transfer body prior to transferring the image to the recording medium.

8. An image forming method according to claim 1, further comprising a step of cleaning the surface of the intermediate transfer body.

9. An image forming method according to claim 1, further comprising a step of performing the hydrophilic treatment to the surface of the intermediate transfer body.

10. An image forming method comprising the steps of:

performing plasma processing to a surface of an intermediate transfer body to make the surface hydrophilic;

applying a liquid, for coagulating a colorant of ink, onto the intermediate transfer body having the surface to which the plasma processing has been performed;

forming an image by ejecting ink from an ink jet head onto the intermediate transfer body on which the liquid has been applied; and transferring the image formed on the intermediate transfer body to a recording medium.

11. An image forming method comprising the steps of:

performing plasma processing to a surface of an intermediate transfer body, the surface containing at least one of fluororubber and silicone rubber, to make the surface hydrophilic;

applying a liquid, for coagulating a colorant of ink, onto the intermediate transfer body having the surface to which the plasma processing has been performed;

forming an image by ejecting ink from an ink jet head onto the intermediate transfer body on which the liquid has been applied; and transferring the image formed on the intermediate transfer body to a recording medium.

12. An image forming method comprising the steps of:

applying a liquid, for coagulating a colorant of ink, onto an intermediate transfer body to which a hydrophilic treatment by plasma processing has been performed;

forming an image by ejecting ink from an ink jet head onto the intermediate transfer body on which the liquid has been applied; and transferring the image formed on the intermediate transfer body to a recording medium.

13. An image forming method according to claim 12, wherein the surface contains at least one of fluororubber and silicone rubber.

* * * * *